US008146561B2

(12) United States Patent
Pryor et al.

(10) Patent No.: US 8,146,561 B2
(45) Date of Patent: Apr. 3, 2012

(54) DYNAMIC ENGINE OIL PICKUP SYSTEM

(75) Inventors: Bryan K. Pryor, Farmington, MI (US); David R. Staley, Flushing, MI (US); Bryce E. Mazzola, Dryden, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 787 days.

(21) Appl. No.: 12/124,281

(22) Filed: May 21, 2008

(65) Prior Publication Data

US 2009/0288633 A1 Nov. 26, 2009

(51) Int. Cl.
*F01M 9/10* (2006.01)

(52) U.S. Cl. ..... 123/196 R

(58) Field of Classification Search ..... 184/6.2, 184/6.5, 6.8, 6.13; 123/196 R
See application file for complete search history.

(56) References Cited

U.S. PATENT DOCUMENTS

| | | | | |
|---|---|---|---|---|
| 4,296,716 | A * | 10/1981 | Hofbauer et al. | 123/195 C |
| 5,979,616 | A * | 11/1999 | Smith | 188/266.1 |
| 6,260,534 | B1 * | 7/2001 | Kampichler et al. | 123/196 R |
| 6,463,819 | B1 * | 10/2002 | Rago | 184/6.2 |
| 6,776,262 | B2 * | 8/2004 | Hur | 184/106 |
| 7,588,011 | B2 * | 9/2009 | Ono et al. | 123/196 R |

* cited by examiner

*Primary Examiner* — Michael Cuff
*Assistant Examiner* — Tea Bajramovic
(74) *Attorney, Agent, or Firm* — Quinn Law Group, PLLC

(57) ABSTRACT

A dynamic engine oil pickup system is disclosed. The dynamic engine oil pickup system includes a scavenge pump and a pickup tube assembly in fluid communication with the scavenge pump. The pickup tube assembly includes at least two oil pickup portions operable to pickup engine oil from at least two different oil pickup locations and a flow control operable to control a flow of engine oil between the at least two different oil pickup locations and the scavenge pump. The flow control includes a suction valve, and movement of the suction valve is controlled by selectively applying a high pressure oil to a head of the suction valve.

17 Claims, 5 Drawing Sheets

DYNAMIC ENGINE OIL PICKUP SYSTEM

TECHNICAL FIELD

This invention relates generally to engine oil pickup systems and, more particularly, to a dynamic engine oil pickup system that scavenges engine oil from more than one pickup point.

BACKGROUND OF THE INVENTION

Known engine lubrication systems include an oil pump, an oil pump pickup tube, an oil filter and a sump including an oil pan. Engine oil is sucked out of the oil pan by the oil pump via the oil pump pickup tube. The engine oil is then run through the oil filter to remove any debris, and squirted under high pressure to lubricate various engine components. The engine oil then flows by gravity down to the bottom of the sump or the oil pan, where it is collected again and the cycle repeats.

Dry sump lubrication systems are commonly used in high performance engine applications where the vehicle is exposed to high "g" maneuvers, such as those experienced in race course driving. During these maneuvers, forces are created, which act to inhibit the ability of the engine oil to flow back to the oil pump pickup tube. By using a dry sump lubrication system, multiple pumps scavenge engine oil from various locations within the engine crankcase environment. These multiple pumps then transfer the scavenged engine oil to a container, which is typically remotely located external to the engine. Once in the remotely located container, a second pump draws the engine oil from the container to pressurize the engine's lubrication system.

One known engine lubrication system incorporates a dry sump lubrication system including a single scavenging pump that scavenges engine oil from a single location within the engine. However, in this known application, packaging constraints prevent multiple pumps, which could scavenge from multiple locations, from being incorporated.

Another known engine lubrication system incorporates a dry sump lubrication system including a single scavenging pump with multiple inputs, or pickup points. However, in this known application, the single scavenging pump draws engine oil from all pickup points into the scavenging pump whenever the scavenging pump is activated, regardless of whether engine oil is present at each of the pickup points, resulting in reduced scavenging pump performance.

SUMMARY OF THE INVENTION

A dynamic engine oil pickup system is disclosed. The dynamic engine oil pickup system includes a scavenge pump and a pickup tube assembly in fluid communication with the scavenge pump. The pickup tube assembly includes at least two oil pickup portions operable to pickup engine oil from at least two different oil pickup locations.

The dynamic engine oil pickup system further includes a flow control which is in fluid communication with both the scavenge pump and the pickup tube assembly. The flow control is operable to control a flow of engine oil between the at least two different oil pickup locations and the scavenge pump. The flow control includes a suction valve, and movement of the suction valve is controlled by selectively applying a high pressure oil to a head of the suction valve.

The suction valve is moveable from a first position to a second position. The suction valve blocks the flow of engine oil from one of the at least two different oil pickup locations when the suction valve is in the first position and blocks the flow of engine oil from another of the at least two different oil pickup locations when the suction valve is in the second position.

The dynamic engine oil pickup system further includes an electric solenoid valve in communication with the suction valve. Actuation of the electric solenoid valve results in the application of the high pressure oil to the head of the suction valve.

A dynamic engine oil pickup tube assembly is also disclosed. The dynamic engine oil pickup tube assembly includes a manifold portion and at least two oil pickup portions extending from the manifold portion. The at least two pickup portions are operable to pickup engine oil from at least two different oil pickup locations and a flow control in fluid communication with the at least two pickup tube portions. The flow control is operable to control a flow of engine oil between the at least two different oil pickup locations and a scavenge pump.

The flow control is moveable within the manifold portion from a first position to a second position. The flow control includes a suction valve, and movement of the suction valve is controlled by selectively applying a high pressure oil to a head of the suction valve.

The suction valve blocks the flow of engine oil from one of the at least two different oil pickup locations when the suction valve is in the first position and blocks the flow of engine oil from another of the at least two different oil pickup locations when the suction valve is in the second position.

The suction valve further includes a return spring and an electric solenoid valve in communication with the suction valve. The return spring is operable to move the suction valve to the second position when the high pressure oil is removed from the head of the suction valve. Actuation of the electric solenoid valve results in the application of the high pressure oil to the head of the suction valve.

An internal combustion engine including the dynamic engine oil pickup system discussed above is also disclosed.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
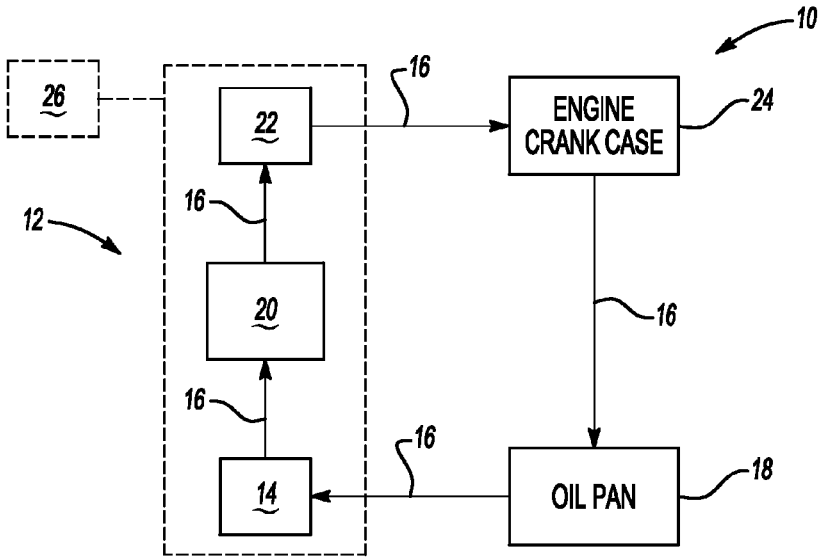
FIG. 1 is a schematic illustration of an internal combustion engine including a dry sump engine lubrication system according to one embodiment of the present invention.

Referring to the drawings, wherein like reference numbers refer to like components, FIG. 1 is a schematic illustration of an internal combustion engine, indicated generally at 10, including a dry sump lubrication system, indicated generally at 12. The dry sump lubrication system 12 includes a scavenging oil pump 14 that scavenges engine oil 16 from an oil pan 18 and sucks the scavenged engine oil 16 into an external container 20. An engine oil pump 22 then delivers the scavenged engine oil 16 to an engine crankcase 24 to lubricate various engine components.

A switching device, schematically illustrated at 26, which may include but is not limited to a computer and/or a mercury switch, is in operable communication with the dry sump lubrication system 12. The switching device 26 is operable to detect a vehicle characteristic, which may include but is not limited to a vehicle attitude characteristic and/or a vehicle dynamic characteristic.

Figure 2:
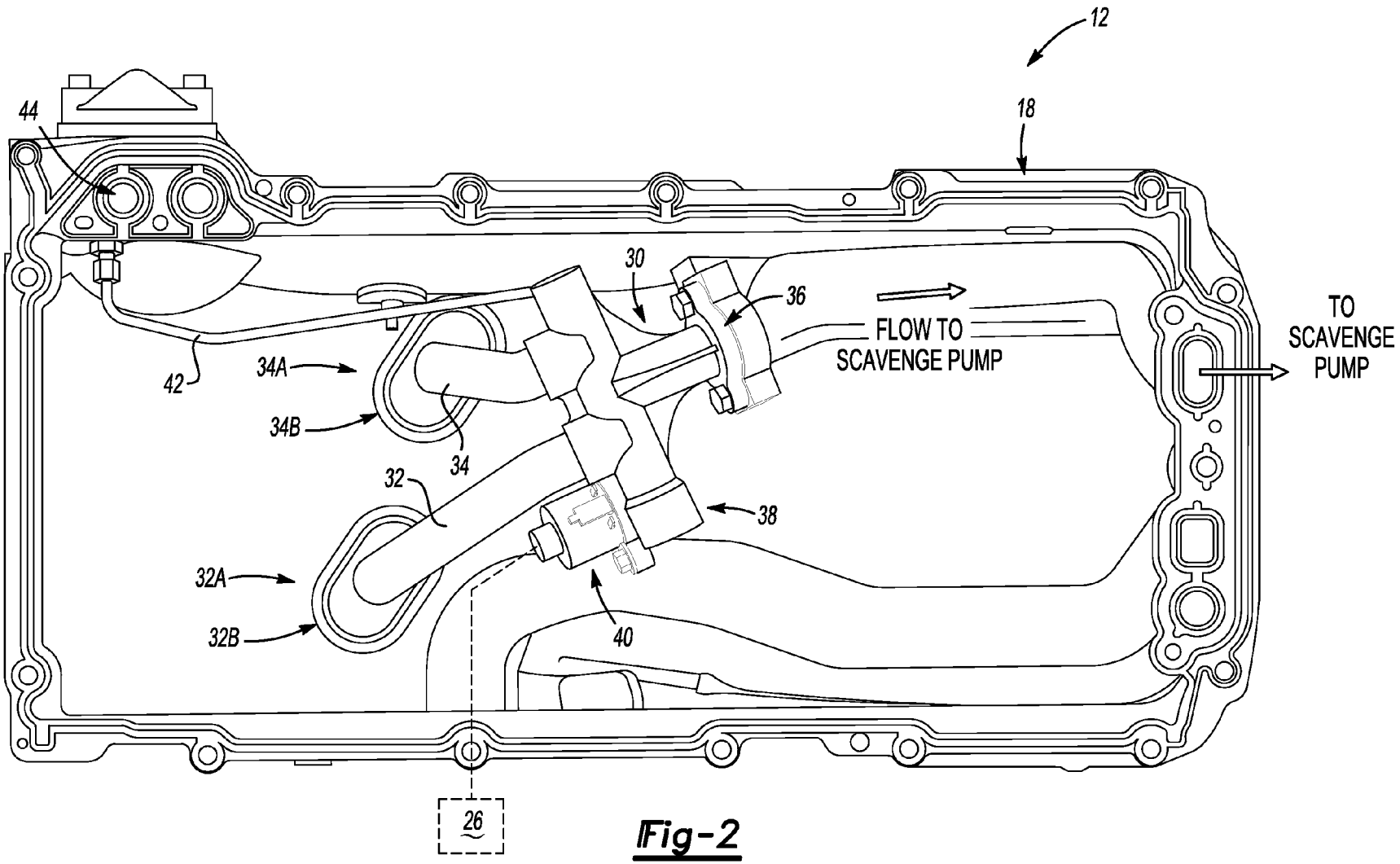
FIG. 2 is a schematic illustration of a dry sump engine lubrication system including a dynamic engine oil pickup system according to one embodiment of the present invention.

As illustrated in FIG. 2, the dry sump lubrication system 12 is a dynamic engine oil pickup system, which includes an oil pan 18 and a dynamic engine oil pickup tube assembly 30 in fluid communication with a scavenging pump (not shown). The dynamic pickup tube assembly 30 includes a first pickup portion 32 and a second pickup portion 34 both extending from a scavenging manifold section 36, and a flow control generally indicated at 38, which includes an electric solenoid valve 40. It should be appreciated, however, that the dynamic engine oil pickup assembly 30 may have more than two pickup portions extending from the scavenging manifold section 36, and that the flow control 38 would be in communication with all of the pickup portions.

The first pickup portion 32 is operable to pick up engine oil from a first pickup location 32A through a first baffle 32B that is optimized for best performance. The second pickup portion 34 is operable to pick up engine oil from a second pickup location 34A through a second baffle 34B that is optimized for best performance. It should be appreciated that the more available pickup point locations the better the scavenging system performs.

High pressure oil is delivered to the dynamic engine oil pickup tube assembly 30 through a high pressure oil feed line 42 from a high pressure oil gallery 44 within the oil pan 18.

Figure 3A:
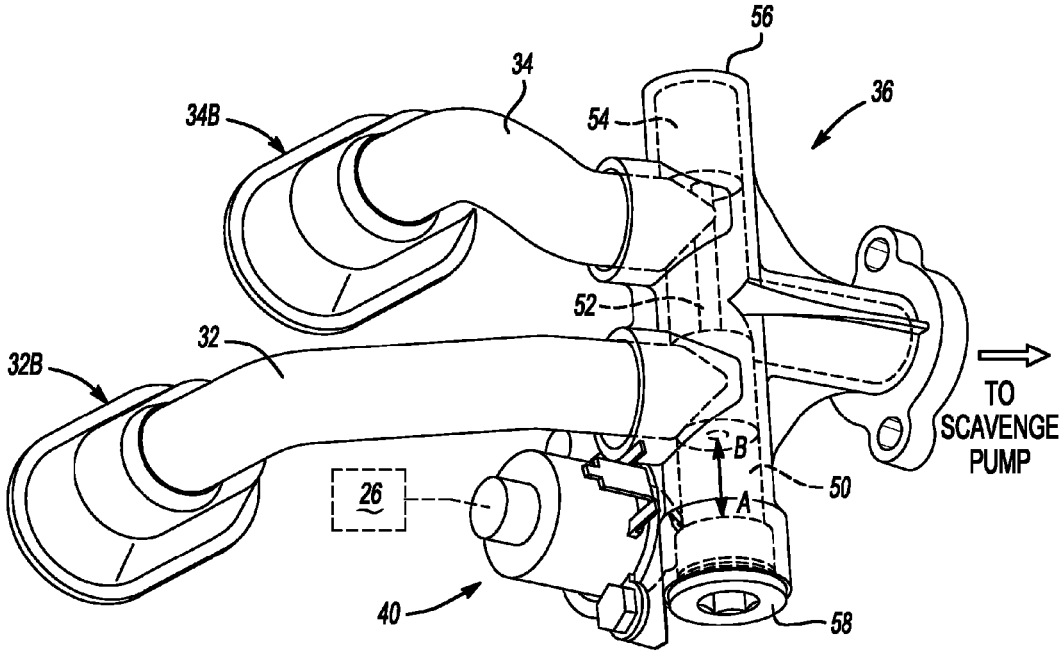
FIG. 3A is a schematic illustration of a dynamic engine oil pickup tube assembly according to one embodiment of the present invention.
Figure 3B:
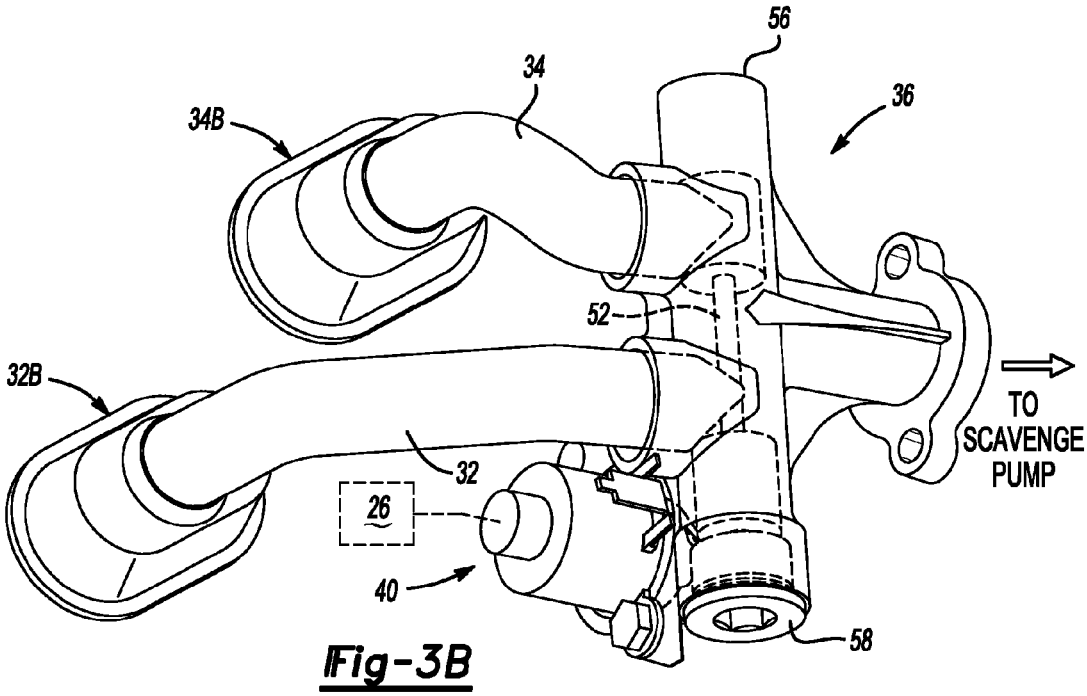
FIG. 3B is a schematic illustration of the dynamic engine oil pickup tube assembly of FIG. 3A with the suction valve in a second position.

As illustrated in FIG. 3A, the high pressure oil is delivered to a pressure chamber 50 located within the scavenging manifold section 36. A suction valve 52 moves from a first position A to a second position B (FIG. 3B) within the scavenging manifold section 36 in response to the high pressure oil being received within the pressure chamber 50 from the high pressure oil feed line 42).

The switching device, schematically illustrated at 26, is in operable communication with the electric solenoid valve 40 and the suction valve 52. The switching device 26 is operable to selectively control a position of the suction valve 52, allowing the high pressure oil to be delivered through the solenoid valve 40 when energized. The suction valve 52 is disposed within the scavenging manifold section 36 and movable from a first position to only a second position, and wherein the movement of the suction valve is controlled by selectively applying a high pressure oil to a head of the suction valve.

The pressure chamber 50 is located at one end of the suction valve 52, while a return spring 54 is installed at the opposite end of the suction valve 52. The return spring 54 is operable to return the suction valve 52 to the first position A in the absence of high pressure oil within the pressure chamber 50.

An air/oil vent hole 56 is provided at one end of the scavenging manifold portion 36, while a suction valve access plug 58 is provided at the other end of the scavenging manifold portion 36 to provide access to the suction valve 52. Alternatively, the air/oil vent hole 56 can be provided within the suction valve 52.

As the suction valve 52 moves from the first position A to the second position B, first and second heads, 52A and 52B respectively, of the suction valve are operable to selectively block flow of engine oil from the first pickup portion 32 and/or the second pickup portion 34 to the scavenge pump (not shown).

As discussed above, the suction valve 52 moves from the first position A to the second position B in response to an increase in oil pressure within the pressure chamber 50.

Figure 4:
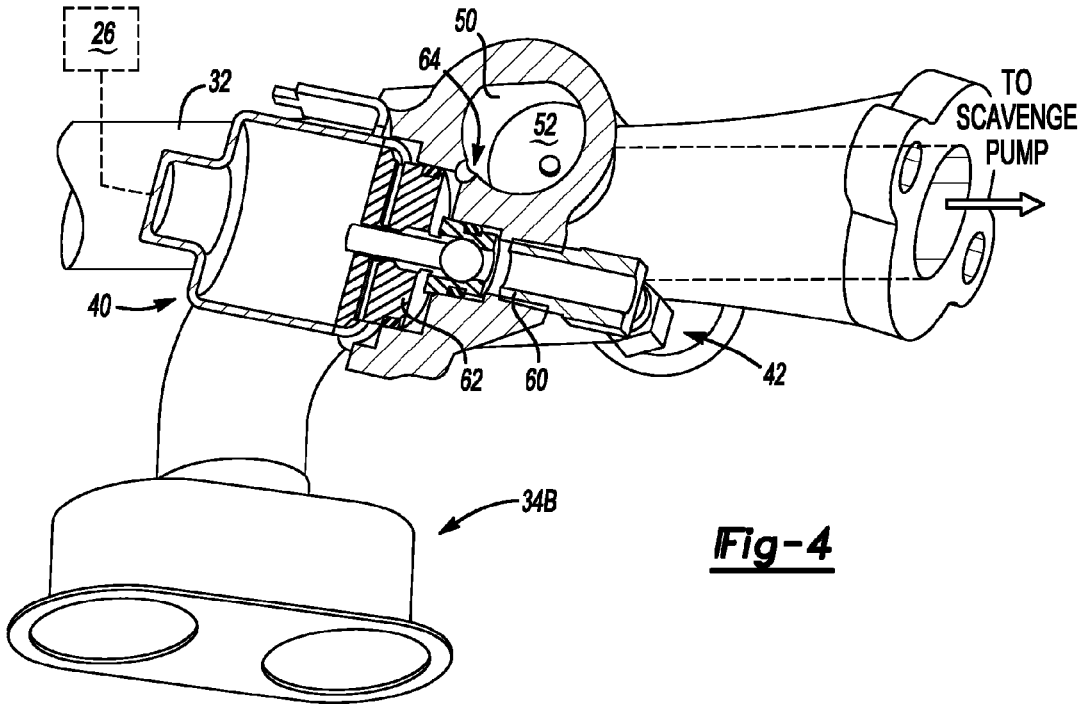
FIG. 4 is a cross-sectional view of the dynamic engine oil pickup tube assembly of FIG. 3A.

As illustrated in FIG. 4, high pressure oil from the high pressure oil feed line 42 is received within a high pressure oil supply portion 60 of the solenoid control valve 40. Upon receipt of an activation signal from the switching device, schematically illustrated at 26, the solenoid valve 40 is energized, as illustrated further in FIG. 4B. Once energized, a plunger 62 within the solenoid control valve 40 is actuated, allowing the high pressure oil to enter a high pressure control port 64. The high pressure control port 64 then feeds the high pressure oil to the pressure chamber 50, activating the suction valve 52 and moving it from the first position A to the second position B (FIG. 3A).

Figure 4A:
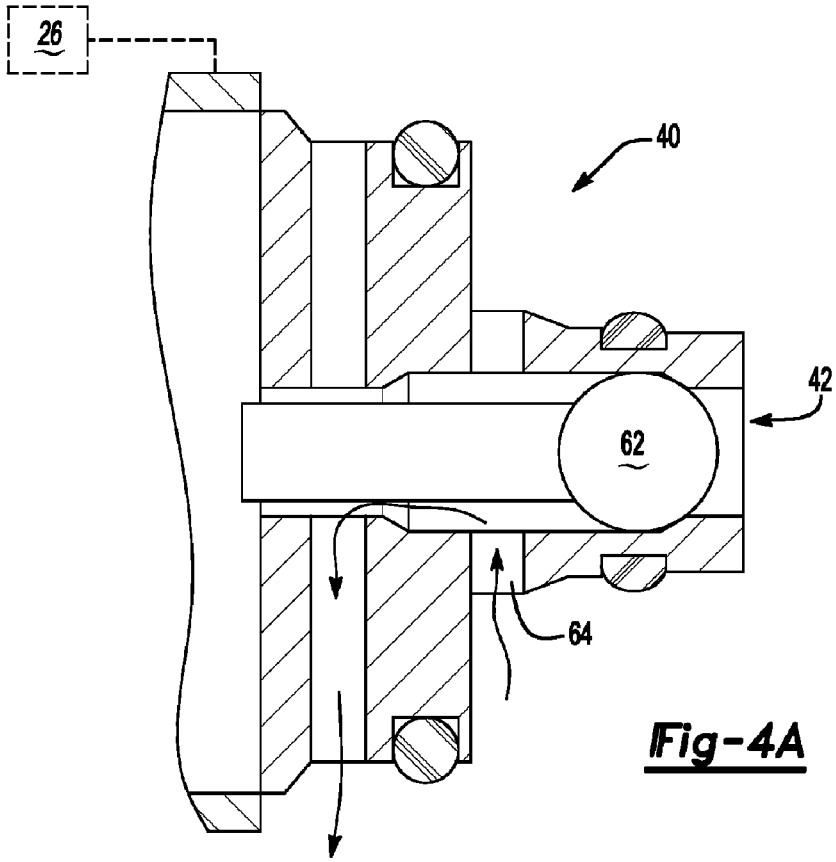
FIG. 4A is a schematic illustration of a portion of the solenoid valve in a de-energized state.

Upon discontinuation of the activation signal or receipt of a deactivation signal from the switching device 26, the solenoid valve 40 is de-energized, as illustrated further in FIG. 4A. Once de-energized, the plunger 62 returns, preventing the high pressure oil from flowing into the high pressure control port 64 and pressurizing the pressure chamber 50 to activate the suction valve 52, thus returning the suction valve 52 from the second position B back to the first position A (FIG. 3A).

As illustrated in FIG. 4A, the solenoid valve 40 is in a de-energized state. In the de-energized state, the plunger 62 is located in a first position that prevents the high pressure oil from the high pressure oil feed line 42 from flowing into the high pressure control port 64. Thus preventing the high pressure oil from feeding the pressure chamber 50.

Figure 4B:
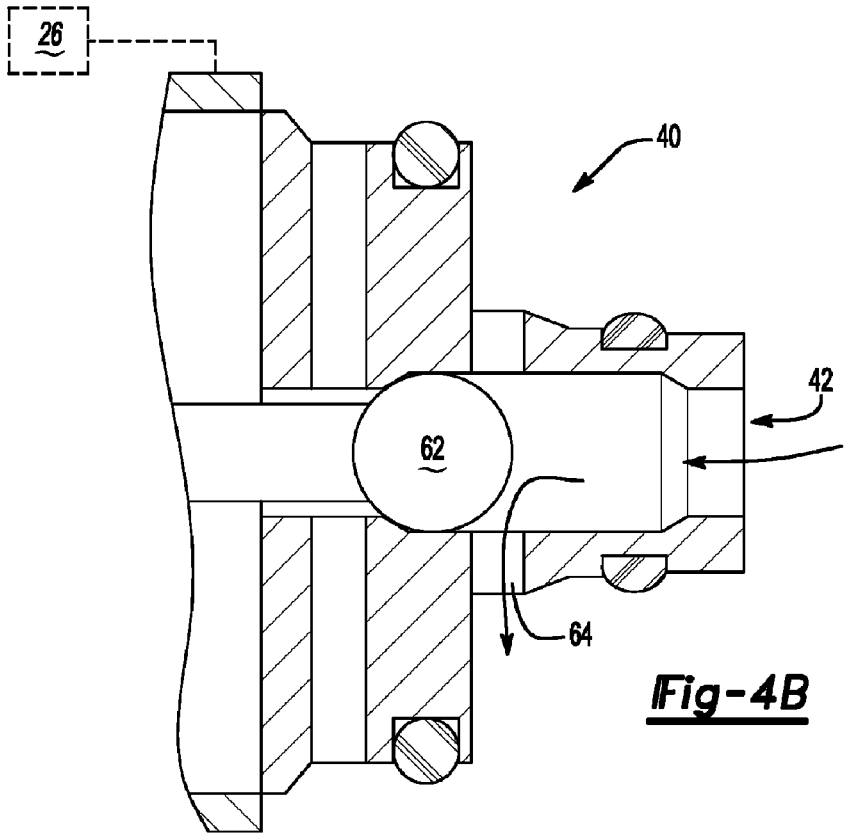
FIG. 4B is a schematic illustration of a portion of the solenoid valve is an energized state.

As illustrated in FIG. 4B, upon receipt of the activation signal from the switching device, schematically illustrated at 26, the solenoid valve 40 is in an energized state. In the energized state, the plunger 62 moves from the first position to a second position that allows the high pressure oil from the high pressure oil feed line 42 to flow into the high pressure control port 64 and feed the high pressure oil to the pressure chamber 50, activating the suction valve 52 and moving it from the first position A to the second position B (FIG. 3A).

Figure 5:
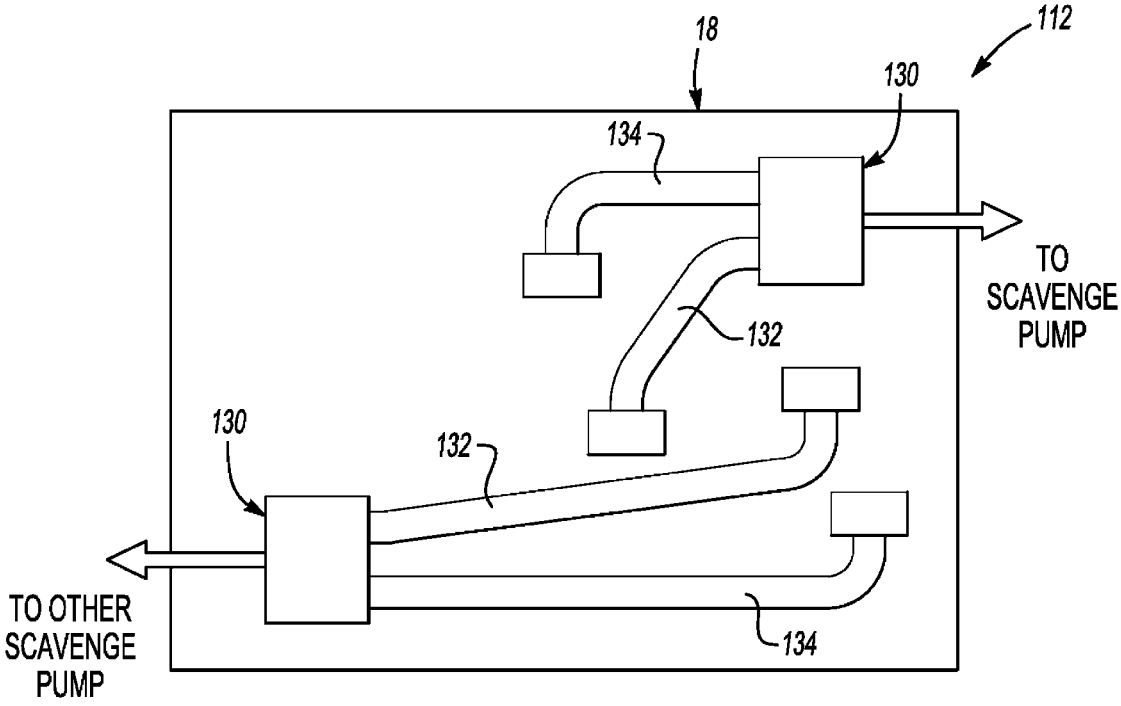
FIG. 5 is a schematic illustration of a dynamic engine oil pickup system according to another embodiment of the present invention.

It should be appreciated that the dynamic engine oil pickup system 112 may include more than one dynamic engine oil pickup tube assembly 130, each in fluid connection with a separate scavenging pump and, as discussed above, each dynamic engine oil pickup tube assembly 130 includes at least two pickup portions 132 and 134, as illustrated in FIG. 5.

While the best modes for carrying out the invention have been described in detail, those familiar with the art to which this invention relates will recognize various alternative designs and embodiments for practicing the invention within the scope of the appended claims.

The invention claimed is:

1. A dynamic engine oil pickup system comprising:

a scavenge pump;

a dynamic engine oil pickup tube assembly in fluid communication with the scavenge pump, wherein the dynamic engine oil pickup tube assembly includes a scavenging manifold section in fluid communication with the scavenge pump, and at least a first oil pickup portion and a second oil pickup portion each extending outward from the scavenging manifold section;

wherein the first oil pickup portion is operable to pickup engine oil from only a first oil pickup location;

wherein the second oil pickup portion is operable to pickup engine oil from only a second oil pickup location that is different from the first oil pickup location; and a suction valve disposed within the scavenging manifold section and moveable from a first position to only a second position, wherein movement of the suction valve is controlled by selectively applying a high pressure oil to a head of the suction valve;

wherein the first oil pickup portion is not disposed in fluid communication with the second oil pickup portion;

wherein the first oil pickup portion is not disposed in fluid communication with the second oil pickup portion when the suction valve is disposed in the first position;

wherein the second oil pickup portion is not disposed in fluid communication with the first oil pickup portion when the suction valve is disposed in the second position.

2. The dynamic engine oil pickup system as recited in claim 1, further including an electric solenoid valve in communication with the suction valve, wherein actuation of the electric solenoid valve results in the application of the high pressure oil to the head of the suction valve.

3. The dynamic engine oil pickup system as recited in claim 2, wherein actuation of the electric solenoid is controlled by a mercury switch.

4. The dynamic engine oil pickup system as recited in claim 2, wherein actuation of the electric solenoid is controlled by a vehicle control module.

5. A dynamic engine oil pickup tube assembly comprising:

a scavenging manifold section;

a first oil pickup portion extending outward from the scavenging manifold section and operable to pickup engine oil from only a first oil pickup location;

a second oil pickup portion extending outward from the scavenging manifold section and operable to pickup engine oil from only a second oil pickup location that is different from the first oil pickup location; and a suction valve disposed within the scavenging manifold section and moveable from a first position to only a second position, wherein movement of the suction valve is controlled by selectively applying a high pressure oil to a head of the suction valve;

wherein the first oil pickup portion is not disposed in fluid communication with the second oil pickup portion;

wherein the first oil pickup portion is not disposed in fluid communication with the second oil pickup portion when the suction valve is disposed in the first position;

wherein the second oil pickup portion is not disposed in fluid communication with the first oil pickup portion when the suction valve is disposed in the second position.

6. The dynamic engine oil pickup tube assembly as recited in claim 5, wherein the suction valve allows the flow of engine oil from only the first oil pickup location when the suction valve is in the first position, and wherein the suction valve allows the flow of engine oil from only the second oil pickup location when the suction valve is in the second position.

7. The dynamic engine oil pickup tube assembly as recited in claim 5, wherein the suction valve is moveable to the first position when the high pressure oil is applied to the head of the suction valve and wherein the suction valve is moveable to the second position when the high pressure oil is removed from the head of the suction valve.

8. The dynamic engine oil pickup tube assembly as recited in claim 7, further including a return spring, wherein the return spring is operable to move the suction valve to the second position when the high pressure oil is removed from the head of the suction valve.

9. The dynamic engine oil pickup tube assembly as recited in claim 5, further including an electric solenoid valve in communication with the suction valve, wherein actuation of the electric solenoid valve results in the application of the high pressure oil to the head of the suction valve.

10. An internal combustion engine including a dynamic engine oil pickup system, the dynamic engine oil pickup system comprising:

a scavenge pump;

a dynamic engine oil pickup tube assembly in fluid communication with the scavenge pump, wherein the dynamic engine oil pickup tube assembly includes a scavenging manifold section in fluid communication with the scavenge pump, and at least a first oil pickup portion and a second oil pickup portion each extending outward from the scavenging manifold section;

wherein the first oil pickup portion is operable to pickup engine oil from only a first oil pickup location;

wherein the second oil pickup portion is operable to pickup engine oil from only a second oil pickup location that is different from the first oil pickup location; and a suction valve disposed within the scavenging manifold section and moveable from a first position to only a second position, wherein movement of the suction valve is controlled by selectively applying a high pressure oil to a head of the suction valve;

wherein the first oil pickup portion is not disposed in fluid communication with the second oil pickup portion;

wherein the first oil pickup portion is not disposed in fluid communication with the second oil pickup portion when the suction valve is disposed in the first position;

wherein the second oil pickup portion is not disposed in fluid communication with the first oil pickup portion when the suction valve is disposed in the second position.

11. The dynamic engine oil pickup system as recited in claim 1, wherein only the first oil pickup portion is disposed in fluid communication with the scavenge pump when the suction valve is disposed in the first position.

12. The dynamic engine oil pickup system as recited in claim 11, wherein only the second oil pickup portion is disposed in fluid communication with the scavenge pump when the suction valve is disposed in the second position.

13. The internal combustion engine as recited in claim 10, wherein only the first oil pickup portion is disposed in fluid communication with the scavenge pump when the suction valve is disposed in the first position.

14. The internal combustion engine as recited in claim 13, wherein only the second oil pickup portion is disposed in fluid communication with the scavenge pump when the suction valve is disposed in the second position.

15. The dynamic engine oil pickup system as recited in claim 1, wherein the scavenging manifold section is selectively in fluid communication with either the first oil pickup portion or the second oil pickup portion so that the scavenging manifold section is not in fluid communication with the first oil pickup portion and the second oil pickup portion.

16. The dynamic engine oil pickup tube assembly as recited in claim 5, wherein the scavenging manifold section is selectively in fluid communication with either the first oil pickup portion or the second oil pickup portion so that the scavenging manifold section is not in fluid communication with the first oil pickup portion and the second oil pickup portion.

17. The internal combustion engine as recited in claim 10, wherein the scavenging manifold section is selectively in fluid communication with either the first oil pickup portion or the second oil pickup portion so that the scavenging manifold section is not in fluid communication with the first oil pickup portion and the second oil pickup portion.

* * * * *